US007017565B2

(12) United States Patent
Fuller

(10) Patent No.: US 7,017,565 B2
(45) Date of Patent: Mar. 28, 2006

(54) SUPPLEMENTAL CAPACITIVE DISCHARGE IGNITION SYSTEM

(76) Inventor: Gerald D. Fuller, 7211 Brookside La., San Antonio, TX (US) 78209

( * ) Notice: Subject to any disclaimer, the term of this patent is extended or adjusted under 35 U.S.C. 154(b) by 0 days.

(21) Appl. No.: 10/802,276

(22) Filed: Mar. 17, 2004

(65) Prior Publication Data

US 2005/0205073 A1 Sep. 22, 2005

(51) Int. Cl.
*F02P 3/08* (2006.01)

(52) U.S. Cl. ..... 123/599; 123/600; 123/406.57; 123/641

(58) Field of Classification Search ..... 123/640, 123/641, 406.57, 599, 600
See application file for complete search history.

(56) References Cited

U.S. PATENT DOCUMENTS

| | | | | |
|---|---|---|---|---|
| 1,221,200 | A * | 4/1917 | McClenathen | 123/641 |
| 2,779,898 | A * | 1/1957 | Smits | 123/641 |
| 3,581,724 | A * | 6/1971 | Van Dyke | 123/641 |
| 4,345,575 | A | 8/1982 | Jorgensen | |
| 5,172,675 | A * | 12/1992 | Kurosu et al. | 123/599 |
| 5,197,448 | A | 3/1993 | Porreca et al. | |
| 5,630,384 | A | 5/1997 | Mottier et al. | |
| 5,654,868 | A | 8/1997 | Buer | |
| 5,862,033 | A | 1/1999 | Geisliner et al. | |
| 5,937,829 | A * | 8/1999 | Endou | 123/497 |
| 6,194,793 | B1 | 2/2001 | Fisher, Jr. | |
| 6,462,507 | B1 | 10/2002 | Fisher, Jr. | |
| 6,484,707 | B1 | 11/2002 | Frus et al. | |
| 2002/0170548 | A1 * | 11/2002 | Masters et al. | 123/641 |
| 2003/0056773 | A1 | 3/2003 | Dutt et al. | |

* cited by examiner

*Primary Examiner*—Erick Solis
(74) *Attorney, Agent, or Firm*—Cox Smith Matthews Incorporated

(57) ABSTRACT

A capacitive discharge ignition system for initiating combustion during cold- and hot-ignition of an internal combustion engine requiring minimal mechanical energy input. The capacitive discharge ignition system includes a magneto having a rotor, a first capacitive discharge device electrically connected to the magneto and to an ignition coil of an internal combustion engine and a second capacitive discharge device electrically connected to the first capacitive discharge device, and to the ignition coil. A mechanical startup mechanism, such as a pull-type or kick-type device, is connected to the magneto and adapted to initiate rotation of the rotor, and thereby combustion within the engine. An energy storage device is electrically connected to the second capacitive discharge device and to the magneto. The energy storage device is adapted to store energy generated by the magneto during rotation of the rotor and to provide energy to the ignition coil of the internal combustion engine.

20 Claims, 7 Drawing Sheets

SUPPLEMENTAL CAPACITIVE DISCHARGE IGNITION SYSTEM

BACKGROUND OF THE INVENTION

1. Field of the Invention

This invention pertains, in general, to a capacitive discharge ignition ("CDI") system, and in particular but not by way of limitation, to a supplemental CDI system utilizing an energy storage device for initiation or re-initiation of combustion within internal combustion engines, thereby requiring minimal mechanical energy for initiation or re-initiation of combustion in an engine.

2. History of Related Art

Mechanical-start ignition systems for internal combustion engines are the bane to many users, regardless of the purpose of the engine. This is because the engines, which may be started by kick-starts, pull-starts, or other mechanical-based starting mechanisms, require a large amount of force to provide sufficient spark energy for ignition initiation. This problem becomes readily apparent during re-starting the engine, which may be very hot from prolonged system operation.

Such engines typically utilize magneto-based ignition systems. A magneto is an electric generator, which establishes a magnetic flux through the use of one or more permanent magnets. The magneto is a self-contained unit used advantageously for ignition where a generator and a battery are not needed to supply power to other accessories.

FIG. 1 is a typical magneto 100. The magneto 100 is housed in a magneto frame 110, and includes a left-hand magnet 115 and a right-hand magnet 120 connected thereto. A rotor 125 is also connected to the frame 110 and intermittently provides an electrical path between the left-hand magnet 115 and the right-hand magnet 120. A primary winding 130 of relatively few turns and a secondary winding 135 of a relatively large number of turns are wound over a laminated yoke 140.

The position of the rotor 125 shown in FIG. 1 provides a low reluctance path for the magnetic flux of the left-hand magnet 115 and a high reluctance path for the magnetic flux of the right-hand magnet 120, such that flux goes through the yoke 140 from left to right. When the rotor turns one-eighth of a revolution, it becomes horizontal, with each of the magnets 115, 120 acting in opposition relative to the yoke 140, thus resulting in zero magnetic flux. When the rotor 125 turns one-fourth of a revolution, or 90° from the position shown in FIG. 1, the rotor 125 now provides a low reluctance path for the right-hand magnet 120 and a high-reluctance path for the left-hand magnet 115. Thus the magnetic flux now goes through the yoke 140 from right to left. Each subsequent 90° interval results in the flux in the yoke 140 undergoing a complete reversal, which is generally recognized as an inductor type of A/C generator.

Referring now to FIG. 2, a schematic view of a magneto-ignition system 200 incorporating the magneto 100 of FIG. 1 is shown. A simplified exemplary CDI device 205 is generally described herein and below.

One end of both the primary winding 130 and of the secondary winding 135 is grounded (FIG. 1). The other end of the magneto 100 is connected to a trigger coil 210. This contact to ground is actuated by the trigger coil 210, having solid state electronics, but having the timed release controlled by the CDI 205. A switch is provided to ground and thus short-circuit the secondary winding 135 when it is desired to stop the system 200. A capacitor is connected to the trigger coil 210 and ground to absorb the energy of the spark that occurs when the CDI 205 connects with ground.

Referring to FIGS. 1 and 2 in combination, when the CDI 205 completes the circuit, the primary winding 130 is short-circuited, and the varying flux in the magneto 100 produced by the rotation of the rotor 125 induces an alternating current in the secondary winding 135, which in turn produces an alternating flux in the magneto 100. With the rotation of the rotor 125, the current in the secondary winding 135 rises cyclically to maximum values, and at these instants the CDI causes the circuit to open suddenly, interrupting the current in the primary winding 130 and thus causing a sudden collapse of the flux in the magneto 100. This induces a high-impulse EMF in the secondary winding 125 that is transmitted to the CDI and thence to a proper spark plug(s) 220.

Because the magneto 100 requires some sort of mechanical input to initiate rotation of the rotor 125 therein, on starting, the speed of the magneto 100 may be so low that the EMF is not sufficient to produce a hot spark and/or multiple sparks, and thus initiate combustion in an engine. During re-start of the engine, similar problems occur, such as spark plug fouling, improper engine cylinder thermal properties (i.e. too hot or too cold), improper fuel/air ratio, and similar problems.

In mechanically-timed ignitions, one method of overcoming such problems is by impulse starting, in which a rotor of a magneto is driven through a spring. During cranking the rotor is restrained from turning until the engine moves to the proper firing position, at which time the rotor is suddenly released. The energy stored in the spring produces a high, instantaneous, angular velocity to the rotor, resulting in a high EMF and a hot spark.

Such impulse starters are commonly used in older aircraft applications. However, as can be appreciated by the user of the engine, supplying enough mechanical energy during cranking can be tedious, time-consuming, and wearing. For example, in the motorcycle racing industry, re-starting a hot engine by multiple kick-starts can result in loss of precious amounts of time. Similar frustration is found by the avid (or not-so-avid) lawn care consumer, who must exert large amounts of physical energy while pulling the crank to start or re-start the engine.

In the motorcycle industry in particular, typical motorcycle engine ignition has low spark energy at the lower RPM where starting occurs. Several methods have been used to provide more energy to the spark plugs, and will be described briefly below.

First, spark plugs have been provided with small diameter center electrodes. These have shown to reduce the voltage necessary to ionize the spark plug gap and thus quickly bring the engine to steady-state performance. Such an approach has been shown to assist poor engine performance when fuel/air ratios are too lean (during a cold engine start up) or too rich (during a hot engine start up).

Second, motorcycles have been fitted with automatic and manual compression releases. These releases allow the engine to be kick-started easier through the release of compression in the cylinders, thus increasing the speed of rotation of the rotor, increasing the corresponding spark energy from the magneto.

Third, timing on the ignition systems has been adjusted to optimize the ignition of the fuel/air mixture. These complex systems require precise adjustments to obtain the most efficient mixture of fuel/air in the engine, and assist in minimizing the possibility of kickback, which is the firing of the engine in reverse. The reversal of the engine often causes injury to the rider and mechanical failure in the starting engine.

A choke lever may also be used to enrich the fuel/air mixture in the carburetor. Such an approach is especially useful in cold start situations due to the increased density of the cold air at engine start-up. A hot start lever may likewise be provided to lean out the fuel/air mixture in the carburetor, which also is useful when the engine stalls and an accelerator pump or the like is errantly activated in an attempt to prevent engine stall.

Probably the most obvious approach to solve the start/restart problems in this industry would be installation of an electric starting motor, such as those used in automotive applications. An electric starting motor would spin the engine fast enough and with multiple revolutions to overcome the low spark energy at start up while allowing the engine to reach ideal fuel/air mixture.

Unfortunately, these systems have proven to be less-than-ideal, and as a result are not widely accepted. In particular, each of these systems adds increased weight, which is undesirable, especially in motorcycle racing, lawn mowing, landscaping and similar applications. Further, addition of such components may alter the weight distribution and balance of the mechanism, which is unacceptable in certain applications. Each system further adds significantly increased cost and complexity, and results in unsolvable breakdowns that require professional assistance to repair. Such components may also add increased rotational mass (particularly in the example of the electric starting motor), which is especially noticeable in racing applications where engine acceleration is critical. Finally, each component may be subject to dirt and water contamination, which will foul the starting and charging system of the application, and require significant time to repair.

As a result, all of these solutions go virtually unused in the magneto-based ignition industry, or if they are used, the user deals with the undesired compromise. The current magneto-ignition engines start poorly even in ideal situations, or not at all in less than ideal situations. And most of the current magneto-ignition engines require more tune-ups and repairs than should be necessary. Overall, these engine-starting problems cause far more frustration that need be, at a cost much higher than it should be.

These problems only get worse. Current and pending legislation in the United States mandates the use of four-stroke motorcycle engines, which have notoriously poor starting performance due to environmental concerns. These same concerns affect every industry utilizing magneto-ignition systems, and are forcing many manufacturers to adapt to four-stroke engines.

Add to these problems the harmful environmental effects such existing magneto-based ignition engines create. In particular, the multiple starts and re-starts of these engines release harmful hydrocarbons and other byproducts of fuel that does not combust within the engine. With recent and projected restrictions on the release of harmful environmental products both in U.S. and abroad, these problems will only become more apparent.

SUMMARY OF THE INVENTION

These deficiencies are solved by the present invention, which comprises the incorporation of a supplemental CDI device connected to a magneto-based ignition system for an internal combustion engine having a first CDI device. The first or primary CDI device includes a magneto-based ignition system electrically connected thereto, and to a supplemental CDI device. The supplemental CDI device includes an energy storing device, which may be rechargeable, a control for actuating the supplemental CDI device, a capacitive storing and discharge circuit for storing and delivering spark energy. A charging circuit may be provided for recharging the power in the energy storage device during steady-state operation of the internal combustion engine, a means to deliver the power from the capacitive storing circuit to the internal combustion engine, and a means to recharge the energy storage device during steady-state operation of the internal combustion engine.

The supplemental CDI device is adapted to receive, store and discharge stored energy from the energy storing device into a primary coil connected to a magneto. The primary coil, in turn, directs the stored energy to a secondary coil that is connected to a combustion source, which is used to initiate combustion in an internal combustion engine.

In operation, the supplemental CDI device is electronically connected to a magneto-based ignition system. During initial startup, mechanical energy provided by such devices as a pull-start mechanism or a kick-start mechanism, or even an electric start motor, is used to trigger the supplemental CDI device to bypass the magneto and first CDI device, to go to the primary coil and ignite the fuel/air mixture in a cylinder of the engine. After ignition, the supplemental CDI device is deactivated, and the first CDI device is activated. At this point the magneto continues to generate energy, at least a portion of which is stored in the energy storing device of the supplemental CDI system.

Should the engine cease to run, the supplemental CDI device is re-activated. Minimal mechanical energy is then required from a mechanical power source to rotate the magneto due to supplemental energy from the energy storing device of the supplemental CDI device, which results in the transfer of energy from the supplemental CDI device to the primary coil of the magneto and the delivery of high-powered energy pulses to the combustion source, thus insuring rapid re-ignition of the engine with minimal mechanical energy input.

Ignition in the engine occurs independent of the first CDI timing, because a control circuit within the supplemental CDI device is adapted to bypass the first CDI device and magneto. Likewise, ignition occurs due to increased spark energy delivered by the supplemental CDI device and multiple sparks, regardless of whether the fuel/air mixture is lean, rich or whether the combustion source is fouled. Upon restart of the engine, the control circuit disables the supplemental CDI device and re-enables the first CDI device.

The present invention thus provides for a rapid, low-energy re-start of an internal combustion engine utilizing a supplemental CDI device in a magneto-based ignition system.

BRIEF DESCRIPTION OF THE DRAWINGS

A more complete understanding of the method and apparatus of the present invention may be obtained by reference to the following detailed description when taken in conjunction with the following Drawings, with like reference numerals denoting like elements, wherein.

DETAILED DESCRIPTION OF THE PREFERRED EMBODIMENTS

Figure 1:
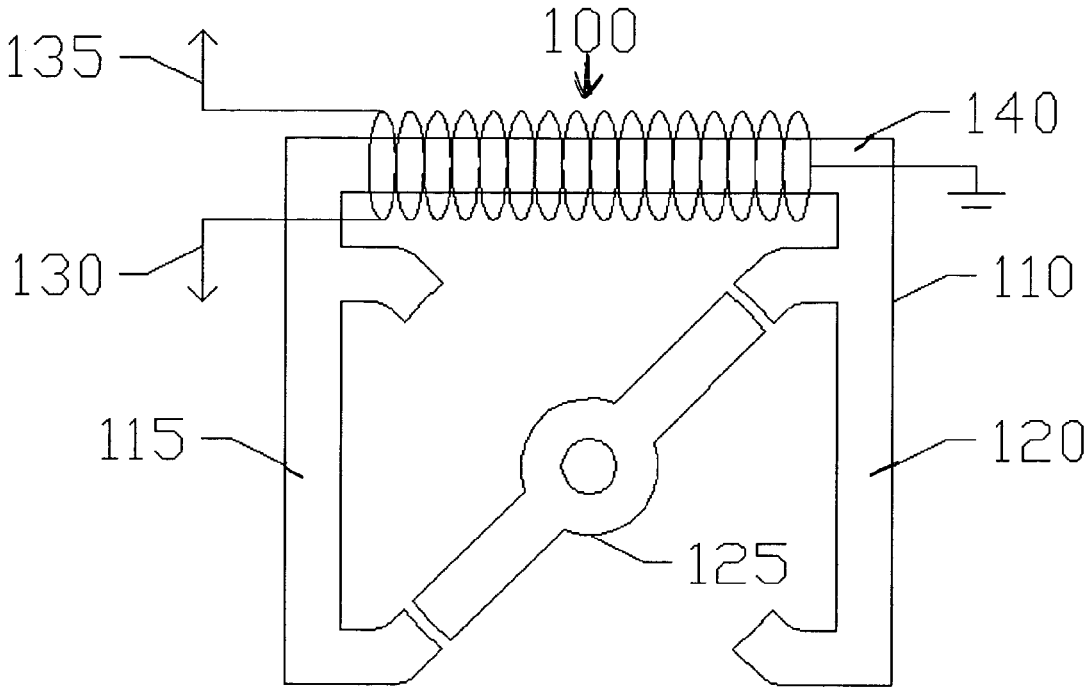
FIG. 1 (PRIOR ART)
FIG. 1 is an exemplary view of a typical magneto.
Figure 2:
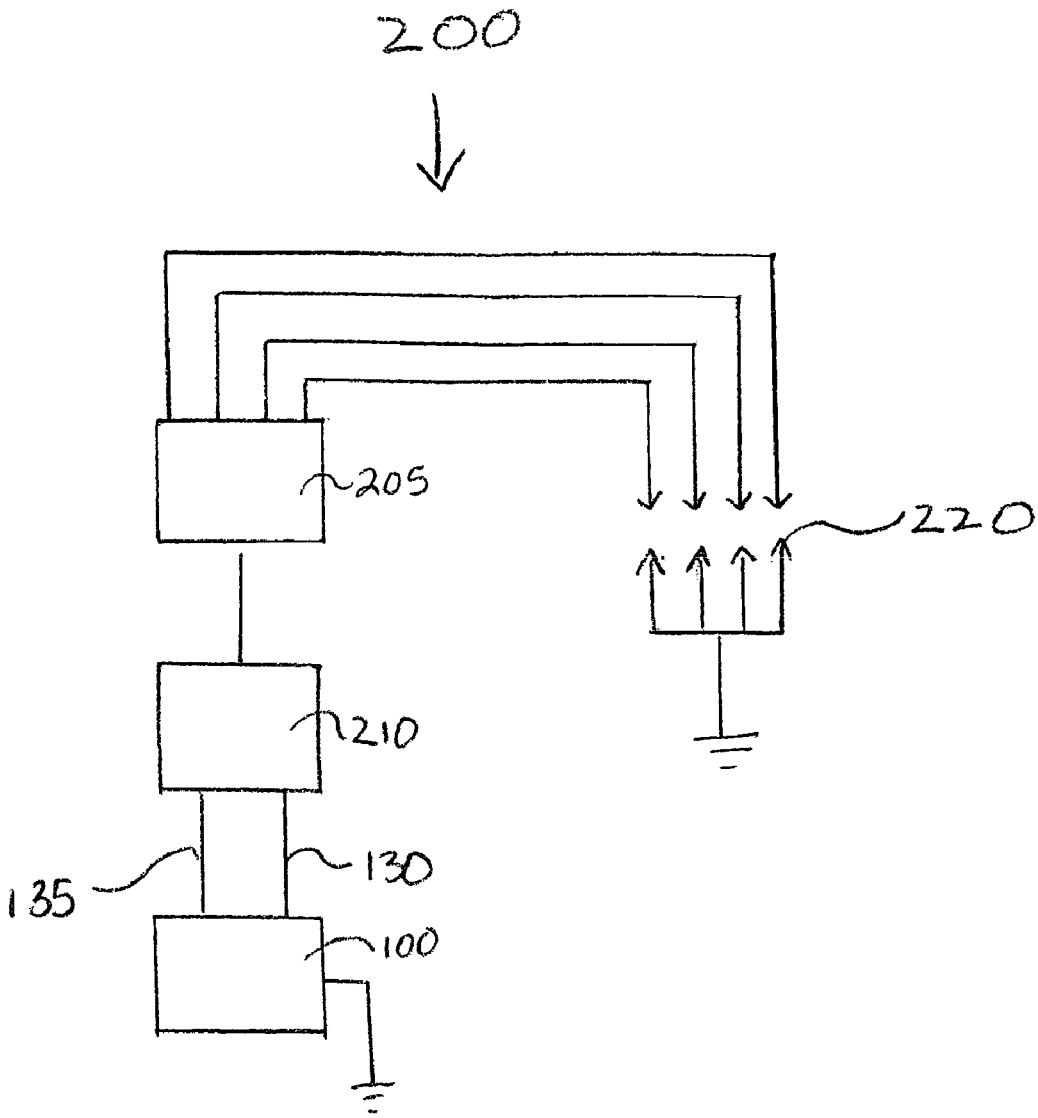
FIG 2 (PRIOR ART)
FIG. 2 is an exemplary schematic view of the magneto of FIG. 1 connected to an ignition system for an internal combustion engine.
Figure 3:
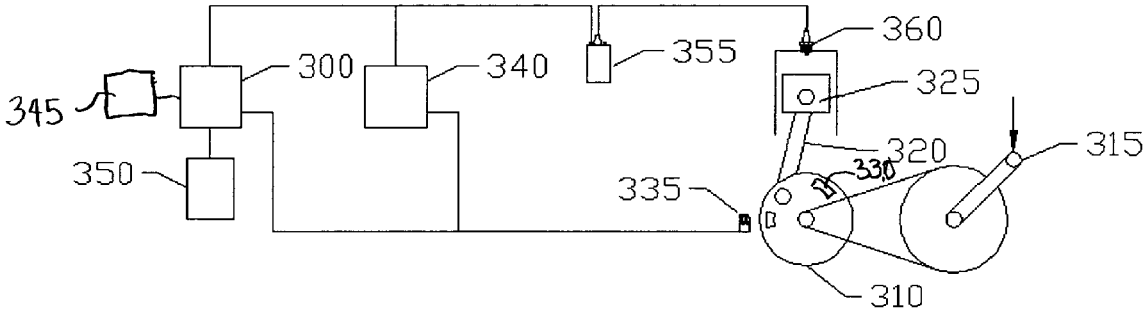
FIG. 3 is a schematic view of one embodiment of the present invention.

Referring first to FIG. 3, a schematic diagram of a supplemental CDI device 300 according to one embodiment of the present invention is shown. Portions of the supplemental CDI device 300 described below are incorporated into a frame housing an internal combustion engine (not shown). A magneto 310 is positioned within and coupled to the frame, and is used for initiating ignition within the internal combustion engine. The magneto 310 is shown coupled to a starting lever 315, which may be a kick-start, a pull-start, or other starting device that can utilize a predetermined mechanical force to turn the internal combustion engine and the magneto 310.

The magneto 310 is coupled to at least one piston shaft 320 having a piston 325 in the internal combustion engine. A primary coil 330 and a pick-up coil 335 are connected to the magneto 310 at one end, and to a supplemental CDI device 300 at the other end. The supplemental CDI device 300, which is described in more detail herein and below, is electrically connected to a first CDI device 340 and includes an energy storing device 345, which may be incorporated therein.

An initiate/reset switch 350 may also be connected to the supplemental CDI device 300 for initiating actuation of the supplemental CDI device 300 or resetting same. The first CDI device 340, in turn, is electrically connected to an ignition coil 355. The ignition coil 355 is connected to one or more spark plugs 360, which are used to initiate combustion in the internal combustion engine.

Figure 4:
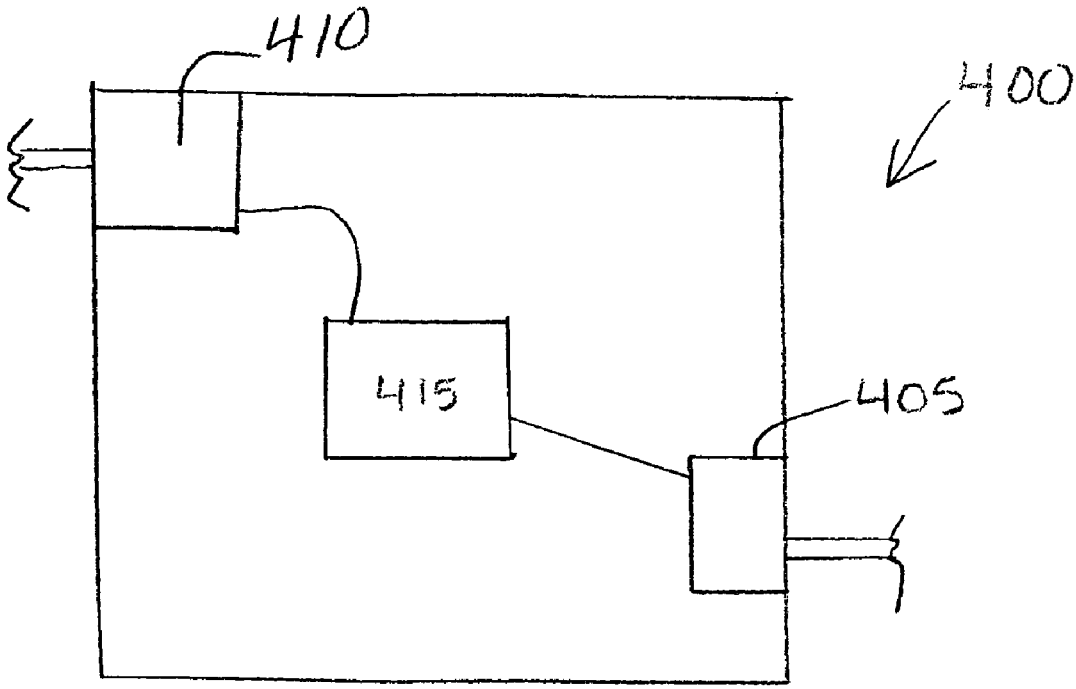
FIG. 4 is a diagrammatic view of an embodiment of an exemplary supplemental CDI-circuit of the present invention.

Referring now to FIG. 4, a schematic diagram of the supplemental CDI device 400 is shown. The supplemental CDI device 400 includes a energy storing device 405 connected to the magneto 310 (FIG. 3), a programmable control 410 for actuating the supplemental CDI device 400, and a programmable capacitive storing and discharge circuit 415 for storing power in the energy storing device 405 during steady-state operation of the internal combustion engine.

The programmable capacitive storing and discharge circuit 415 may be adjusted to deliver power stored in the energy storing device 405 to the internal combustion engine, and may control the recharge of the energy storing device 405 during operation of the internal combustion engine. The programmable functionality of the capacitive discharge and storing circuit 415 provides the user the ability to adjust ignition timing, change performance parameters, and otherwise modify the supplemental CDI device 400, as required by the circumstances. It is to be appreciated that the energy storing device 400 may comprise a battery or a non-rechargeable battery, or other energy storage media, depending on the requirements of the application.

Figure 5:
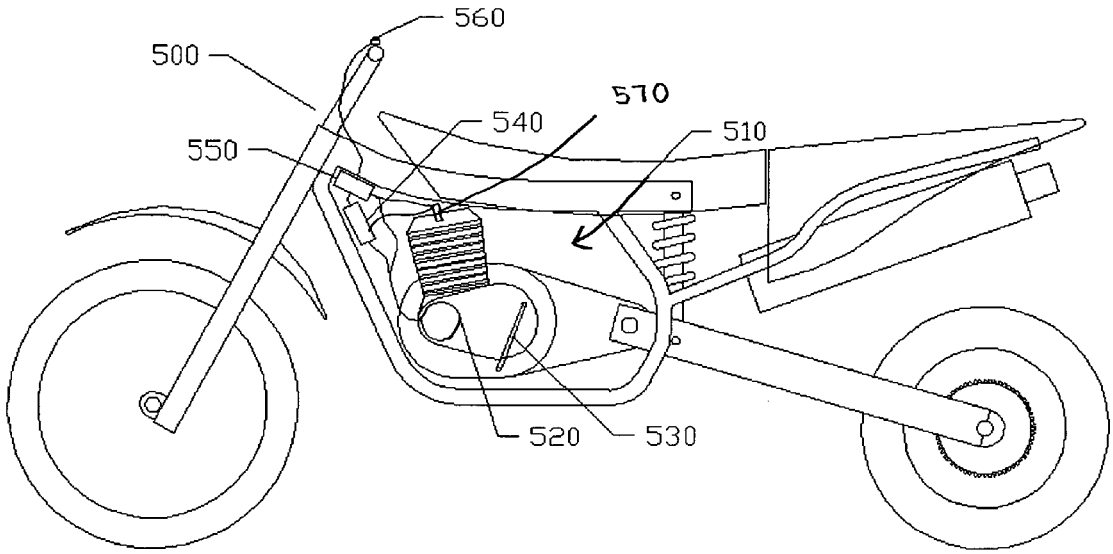
FIG. 5 is a diagrammatic side plan view of an exemplary motorcycle having an embodiment of a supplemental CDI system of the present invention.

Referring now to FIG. 5, a diagrammatic side plan view of an exemplary motorcycle 500 incorporating an embodiment of a supplemental CDI system 510 of the present invention is shown. As can be seen, the supplemental CDI system 510 includes a magneto 520, a mechanical power input source 530 connected to the magneto 520, a first CDI device 540, a supplemental CDI device 550, and a supplemental CDI initiation actuator 560. The first CDI device 540 is connected to the magneto 520, the supplemental CDI device 550, and a combustion initiator 570, such as a spark plug.

The supplemental CDI initiation actuator 560 may comprise a user-operated switch, or an automated control system, the function of which is described in more detail below, wherein a sensor or the like is utilized to determine engine properties and indicate when operation of the supplemental CDI device 550 is required or unnecessary. The supplemental CDI initiation actuator 560 may thus be adapted to engage or disengage the supplemental CDI device 550 manually or automatically. In the motorcycle embodiment of the present invention, the mechanical power input source 530 may comprise a kick-start mechanism, but certain substitutions, such as a pull-start mechanism or a bump-start process such as those used in standard transmission engines and the like may be substituted with no adverse effect on the system.

In addition, the mechanical startup mechanism may be a part of an electrical starting device, where such a device would be appreciated. Toward this end, it is conceived that the supplemental CDI system 510 may be utilized in a variety of applications, such as motorcycles, portable motors including power generators and the like, hand-held lawn grooming equipment, and automotive, aeronautical and aerospace applications. It is also to be appreciated that the supplemental CDI device may be retrofit on present applications or integrated in future applications to improve performance, where desired.

Figure 6:
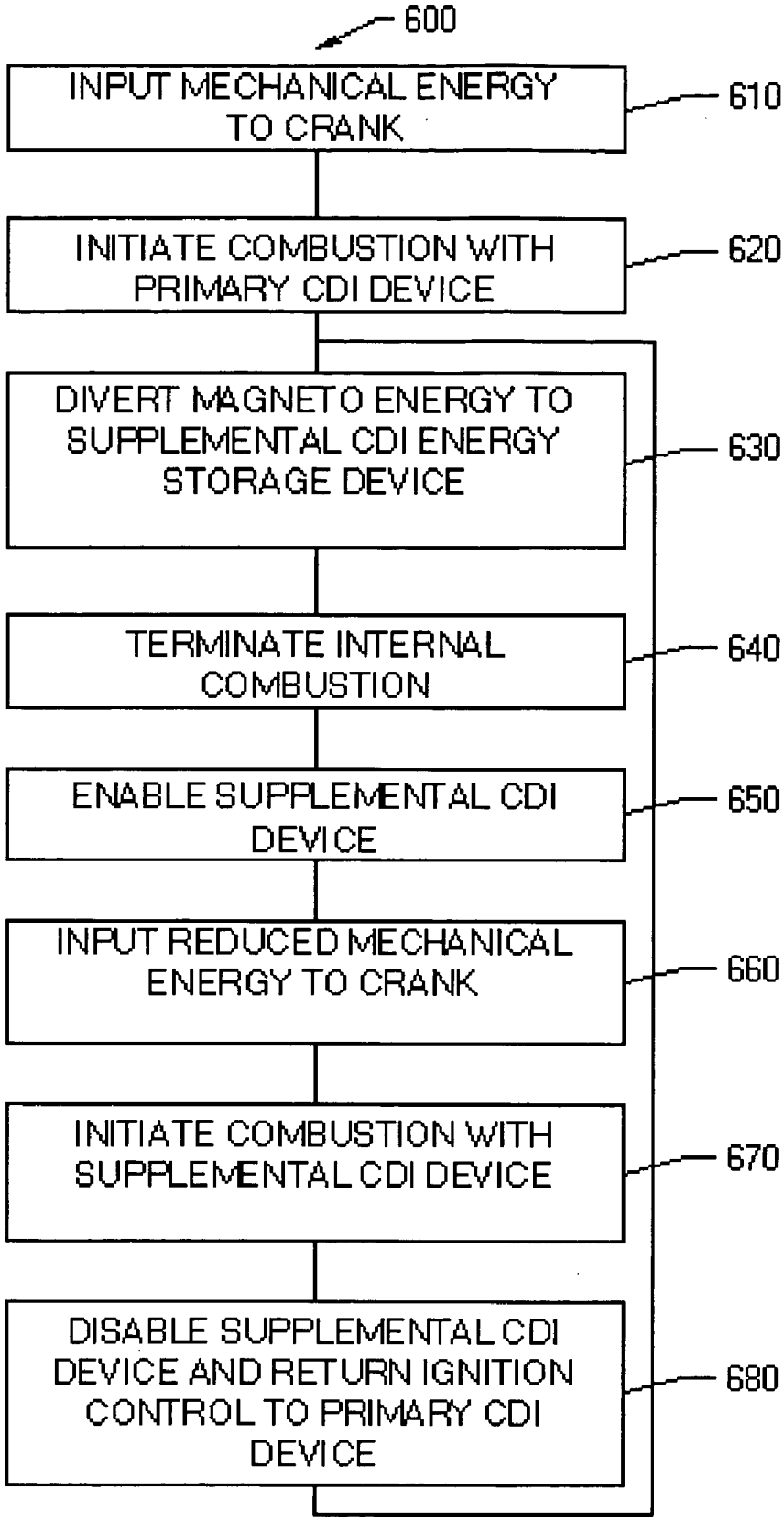
FIG. 6 is an exemplary flow chart outlining one exemplary operational method of an embodiment of the present invention.

Referring now to FIG. 6, an exemplary schematic chart of one exemplary method 600 of operating the supplemental CDI system is shown. To operate the supplemental CDI system, first mechanical energy is provided to spin or "crank" a rotor of a magneto used to initiate combustion in an engine, referenced by 610. Next, a first capacitive device powered by the magneto initiates combustion within the engine, referenced by 620. Upon steady-state combustion, supplemental energy generated by the magneto is diverted to an energy storage device of a supplemental capacitive discharge device, indicated by 630. Next, the engine is stopped, referenced by 640.

The supplemental capacitive discharge device is then actuated, referenced by 650. The supplemental CDI device is enabled, referenced by 650. Mechanical energy is again provided to rotate the rotor, referenced by 660, although it is important to note that only minimal mechanical energy is required during this step due to the energy storage device in the supplemental CDI device. The supplemental capacitive discharge device, powered by the energy storage device, then initiates combustion within the engine by delivering high-powered energy to combustion initiators, such as spark plugs, and thereby initiates the combustion process, referenced by 670.

The supplemental capacitive discharge device is then disengaged upon engine combustion or other suitable circumstances, referenced by 680, and the first capacitive discharge device resumes operation. Power generated by the magneto upon re-start is again stored in the energy storage device, referenced by 630. Thus, the method provides for an efficient, low-energy requirement initiation of combustion in an engine. It is to be appreciated that the apparatus and method may be used to initiate combustion during cold-start or hot-start conditions, should circumstances require.

Figure 7:
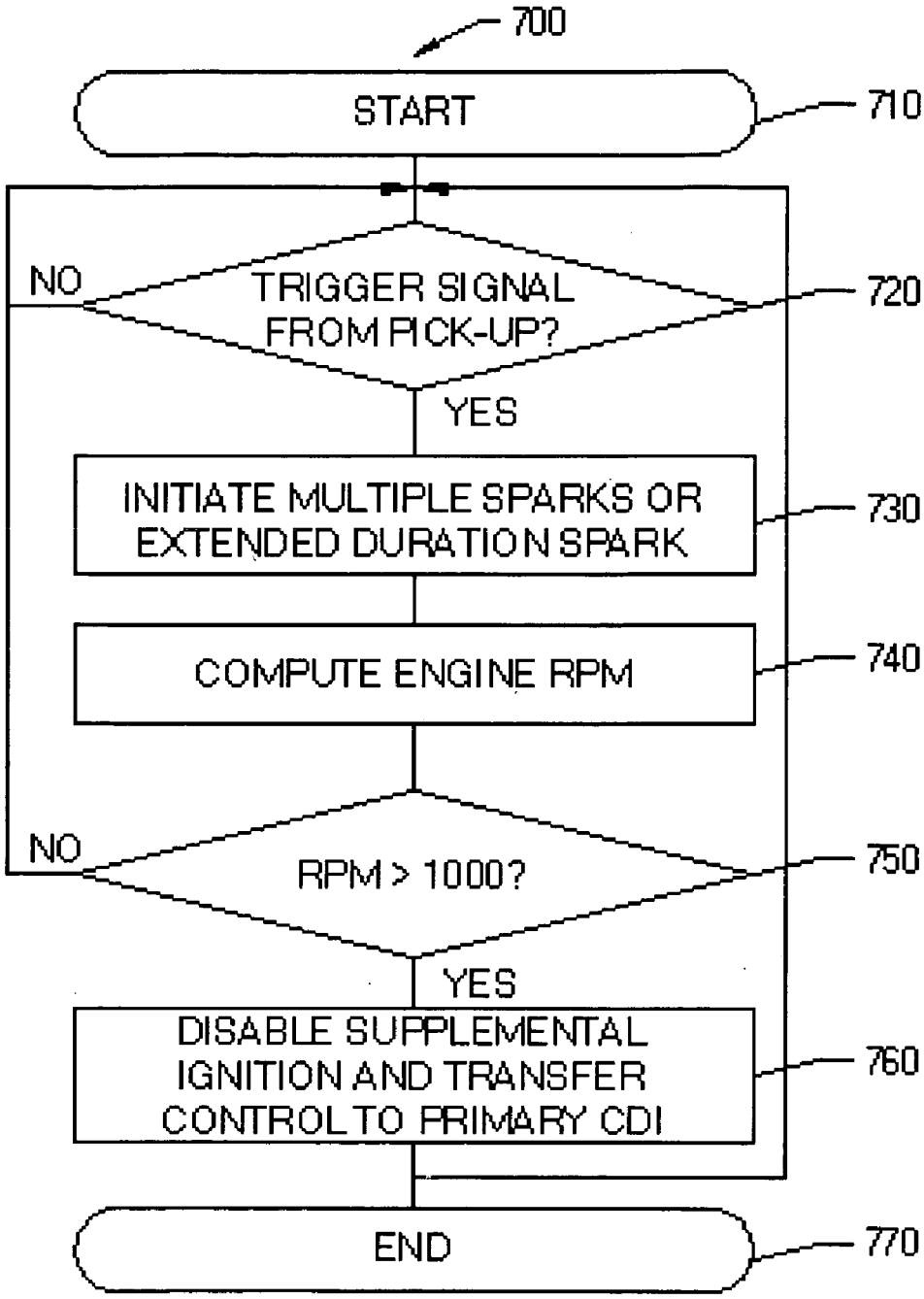
FIG. 7 is a block diagram of a further method of operation for an exemplary embodiment of the present invention.

Referring now to FIG. 7, a block diagram of an exemplary method 700 to operate one embodiment of the present invention is shown. In this diagram, the supplemental CDI system is started, indicated by 700. Next, the supplemental CDI system determines if it has received a trigger signal to initiate combustion, indicated by 720. If so, the supplemental CDI system initiates high energy extended duration sparks or multiple sparks, indicated by 730, to initiate combustion within an internal combustion engine. The engine RPM is then calculated, indicated by 740, and a sensor or the like, well known in the art, is used to indicate whether the RPM is over a threshold amount, such as 1000 RPM, indicated by 750.

If the RPM is over the threshold amount, which may be changed on any given application, according to parameters known in the art, the supplemental CDI device is disabled and ignition is transferred to a primary CDI device, indicated by 760. The process may then be terminated by the user, indicated by 770. If not, the process is repeated until threshold combustion is initiated within the engine.

Because the user of a supplemental CDI system of the present invention may not know when to engage or disengage the supplemental CDI device, a control circuit may be provided to engage or disengage the supplemental CDI device upon predetermined conditions, such as a minimal RPM rate in the engine, or thermal variations due to the initiation of steady-state combustion in the engine. Such a device is contemplated to be within the scope of the present invention. However, such control may be left to the user depending on the application. However, it is contemplated as within the scope of this invention that the user may be provided with controls governing the engagement/disengagement of the supplemental CDI device until combustion is initiated and at desired operation.

Given the advantages provided by the present invention, it is to be appreciated that the energy storage device may be fully charged upon initial ignition of the internal combustion engine. In this condition, minimal mechanical energy is required to initiate combustion due to the provision of energy from the fully-charged energy storage device.

The present invention therefore solves many of the problems in the art. In particular, the present invention assists in reducing harmful emissions through the decrease of hydrocarbons that will result from a single attempt at starting or restarting an engine. The lightweight design of the system provides excellent benefits to those in the lawncare industry, motorcycle industry, portable engine and generator industry, and related fields. The ability to have the energy device recharged further limits consumption of materials, thereby reducing costs and increasing product efficiency. The post-manufacturing installation capability of the present invention on present applications will satisfy most, if not all, practitioners. Finally, the present invention provides the much-needed benefit of a fast start or re-start of the internal combustion engine, with little effort by the user of the internal combustion engine.

Practitioners will further appreciate that the embodiments disclosed above are exemplary only, and that the present invention is not limited thereto, but rather includes all that is reasonably within the literal and equitable scope of the claims that follow.

I claim:

1. A capacitive discharge ignition system, comprising:

a magneto having a rotor;

a first capacitive discharge device electrically connected to the magneto and to an ignition coil of an internal combustion engine;

a second capacitive discharge device electrically connected to the first capacitive discharge device, and to the ignition coil;

a mechanical startup mechanism connected to the magneto and adapted to initiate rotation of the rotor; and an energy storage device electrically connected to the second capacitive discharge device wherein the energy storage device is adapted to store energy from said second capacitive discharge device and provide energy to the ignition coil of the internal combustion engine.

2. The capacitive discharge ignition system of claim 1, wherein the energy storage device comprises a battery.

3. The capacitive discharge ignition system of claim 2, wherein the battery is rechargeable.

4. The capacitive discharge ignition system of claim 3, wherein the battery is adapted to store at least a portion of energy generated by the magneto during rotation of the rotor.

5. The capacitive discharge ignition system of claim 1, further comprising:

means for selectively actuating the second capacitive discharge device.

6. The capacitive discharge ignition system of claim 5, further comprising:

means for measuring properties of the engine during at least one of engine ignition, steady-state combustion, and termination of combustion.

7. The capacitive discharge ignition system of claim 6, wherein the means for measuring properties comprises at least one engine-rotation sensor.

8. The capacitive discharge ignition system of claim 5, wherein the means for selectively actuating comprises a user-operable switch.

9. The capacitive discharge ignition system of claim 1, wherein the mechanical startup mechanism comprises an electric motor.

10. The capacitive discharge ignition system of claim 1, wherein the mechanical startup mechanism comprises a kick-start device.

11. The capacitive discharge ignition system of claim 1, wherein the mechanical startup mechanism comprises a pull-start device.

12. The capacitive discharge ignition system of claim 1, wherein the mechanical startup mechanism is adapted to be actuated by a bump-start process.

13. A capacitive discharge ignition system, comprising:

a capacitive discharge device adapted to initiate combustion within an internal combustion engine;

an energy storage device electrically connected to the capacitive discharge device, wherein the energy storage device is adapted to store energy from said capacitive discharge device and the capacitive discharge device is adapted to deliver energy from the energy storage device to the internal combustion engine; and a control system for controlling storage and release of energy from the energy storage device and initiating combustion within the engine.

14. The capacitive discharge ignition system of claim 13, further comprising:

a magneto connected to the capacitive discharge device.

15. The capacitive discharge ignition system of claim 13, wherein the energy storage device comprises a battery.

16. The capacitive discharge ignition system of claim 15, wherein the battery is rechargeable.

17. The capacitive discharge ignition system of claim 16, wherein the battery is recharged by energy from a magneto.

18. The capacitive discharge ignition system of claim 13, wherein the control system is programmable.

19. A method for combustion re-initiation in an engine utilizing capacitive discharge ignition, comprising:

initiating combustion within the engine using a primary capacitive discharge device;

delivering at least a portion of energy from the engine to an energy storage device associated with a capacitive discharge device;

terminating combustion of the engine;

actuating the supplemental capacitive discharge device; and delivering stored energy from the energy storage device through the supplemental capacitive discharge device to the engine thereby re-initiating combustion within the engine.

20. The method of claim 19, wherein the step of delivering stored energy is preceded by the step of initiating rotation of a rotor within a magneto connected to the engine.

* * * * *

UNITED STATES PATENT AND TRADEMARK OFFICE

CERTIFICATE OF CORRECTION

PATENT NO. : 7,017,565 B2
APPLICATION NO. : 10/802276
DATED : March 28, 2006
INVENTOR(S) : Gerald D. Fuller It is certified that error appears in the above-identified patent and that said Letters Patent is hereby corrected as shown below:

Column 9, line 6, insert the word --supplemental-- before the word "capacitive"

Signed and Sealed this

Eighteenth Day of July, 2006

JON W. DUDAS
*Director of the United States Patent and Trademark Office*